US008314316B1

(12) United States Patent
Erwin

(10) Patent No.: US 8,314,316 B1
(45) Date of Patent: Nov. 20, 2012

(54) FINGER CONTROLLED BOW FOR VIOLIN

(76) Inventor: Ethan Erwin, Malvern, AR (US)

( * ) Notice: Subject to any disclaimer, the term of this patent is extended or adjusted under 35 U.S.C. 154(b) by 0 days.

(21) Appl. No.: 13/096,035

(22) Filed: Apr. 28, 2011

(51) Int. Cl.
*G10D 1/02* (2006.01)
*G10D 3/16* (2006.01)

(52) U.S. Cl. ..... 84/282; 84/325

(58) Field of Classification Search ..... 84/282
See application file for complete search history.

(56) References Cited

U.S. PATENT DOCUMENTS

| | | | | | |
|---|---|---|---|---|---|
| 248,467 | A | * | 10/1881 | Hunt | 84/282 |
| 564,091 | A | * | 7/1896 | Loppentien | 84/282 |
| 1,556,871 | A | * | 10/1925 | Huron | 84/282 |
| 1,632,003 | A | * | 6/1927 | Gaynor | 84/282 |
| 1,673,996 | A | * | 6/1928 | Rathsach | 84/282 |
| 1,897,225 | A | * | 2/1933 | Archer | 84/282 |
| 2,452,396 | A | * | 10/1948 | Shopmaker | 84/282 |
| 2,552,408 | A | * | 5/1951 | Cypher | 84/282 |
| 2,740,312 | A | * | 4/1956 | Vestergaard | 84/282 |
| 3,143,913 | A | * | 8/1964 | Bried | 84/282 |
| 4,453,447 | A | * | 6/1984 | Shinneman | 84/422.4 |
| 5,092,215 | A | * | 3/1992 | Mello et al. | 84/325 |
| 6,777,600 | B2 | * | 8/2004 | Daring | 84/281 |
| 7,595,441 | B1 | * | 9/2009 | DuBell-Shockley | 84/282 |
| D650,829 | S | * | 12/2011 | Kimmons | D17/20 |
| 8,168,871 | B1 | * | 5/2012 | Sweedler | 84/282 |

OTHER PUBLICATIONS

Violin (and Bow) Sizes, dated Nov. 12, 1996, viewed Sep. 17, 2012 at http://www.mccabes.com/violsize.html.*

Violin Sizes 2004-2012, viewed Sep. 17, 2012 at http://www.fiddleheads.ca/shop/violin_sizes.htm.*

* cited by examiner

*Primary Examiner* — Elvin G Enad
*Assistant Examiner* — Robert W Horn
(74) *Attorney, Agent, or Firm* — Dennis B. Haase

(57) ABSTRACT

A novel bow for playing a violin, including a stick of 12 inches in length, more or less; a string attached to the bow and a ring or the like, suitable for receipt of a musician's finger disposed transversely on the stick so that the musician can play the violin in a variety of attitudes. The stick is selectively adjustable to vary the tension on the string.

11 Claims, 2 Drawing Sheets

FINGER CONTROLLED BOW FOR VIOLIN

The present invention relates generally to bows for use in playing a violin and, more particularly, to unique bow construction which permits a violin to be played in various unconventional attitudes.

BACKGROUND OF THE INVENTION

1. Field of the Invention

Since the memory of man runneth not to the contrary, the violin has been played by placing the forward edge of the soundbox of the instrument under the musician's chin, and drawing a bow of 29 inches or so in length, or more, across the violin strings.

Until recently, the music with which the violin is typically associated has remained relatively constant. Currently, there are several performers that wish to sing and play simultaneously. Others fight fatigue as they play the violin in an unnatural position, and still others want to play some of the faster renditions of county/western tunes, but find it exhausting and very difficult with the violin under his or her chin.

The present invention intends to address these concerns.

2. Overview of the Prior Art

There are several prior art patents which address the violin bow in one way or another. As the following demonstrates, none of these patents touch upon, or allude to, the features of the present invention, or the purposes for which it has been created.

Bartholomew patent U.S. Pat. No. 7,795,515, describes what appears to be a rather conventional bow construction with the added feature of the use of laminate, or composite, materials to build the shaft 5. It is noted in column 1 that the inventor describes a rather lengthy history of the bow and its evolution, for whatever benefit that might be.

Cipher, U.S. Pat. No. 2,552,408, patented his violin bow in 1951, and its essence is found in the clamping bracket 26. The size of the bow, however, appears to be conventional in every respect.

Now, things get interesting. In 1922, Mr. Loth patented his tensioning device [U.S. Pat. No. 1,421,510], which permitted him to grip the bow in his teeth, for whatever value that might have. Again, however, the bow appears to be of conventional length.

Archer patent, U.S. Pat. No. 1,897,225, relates to a gripping attachment, which is supported at the frog of the bow and has indentations for the placement of one's hand in gripping the bow which, again, appears to be of conventional length. Berkowski patent, U.S. Pat. No. 1,715,490, is a tensioning device for the bow strings which, it is said, permits the user to increase or decrease tension during playing of the instrument.

Krause patent, U.S. Pat. No. 2,421,567, is yet another device for varying the tensioning of the horse hair, and Pliassov, U.S. Pat. No. 5,918,297, is similar in purpose, namely tensioning of the string, but, as those that have gone before it, the bow appears to be conventional.

Finally, Shinneman patented a bow [U.S. Pat. No. 4,453,447] in 1984, which is to be used on percussion instruments.

It is evident from this analysis that neither the purpose nor the structure of the present invention has been recognized by the prior art.

SUMMARY OF THE INVENTION

The advent of the present invention introduces a new era in the playing of stringed instruments, namely a violin.

A first objective of the present invention is to allow the violin to escape from the chin and shoulder of the musician.

Another objective accomplished by the invention is to provide the musician with the capacity to position the violin similarly to a guitar, or the like, where the musician is able to play the instrument in a more relaxed manner.

Yet another objective of the present invention is to permit the musician to sing or speak, as well as play, the violin simultaneously. An objective related to the foregoing is to permit the musician to play the violin in an exceptionally fast manner with wrist strokes, as distinguished from use of the arm and shoulder, as required by a more conventional instrument.

The foregoing, as well as other objectives and advantages of the present invention, will become apparent from a reading of the Detailed Description of the Preferred Embodiment, taken in concert with the drawings, wherein,

DETAILED DESCRIPTION OF A PREFERRED EMBODIMENT

Figure 1:
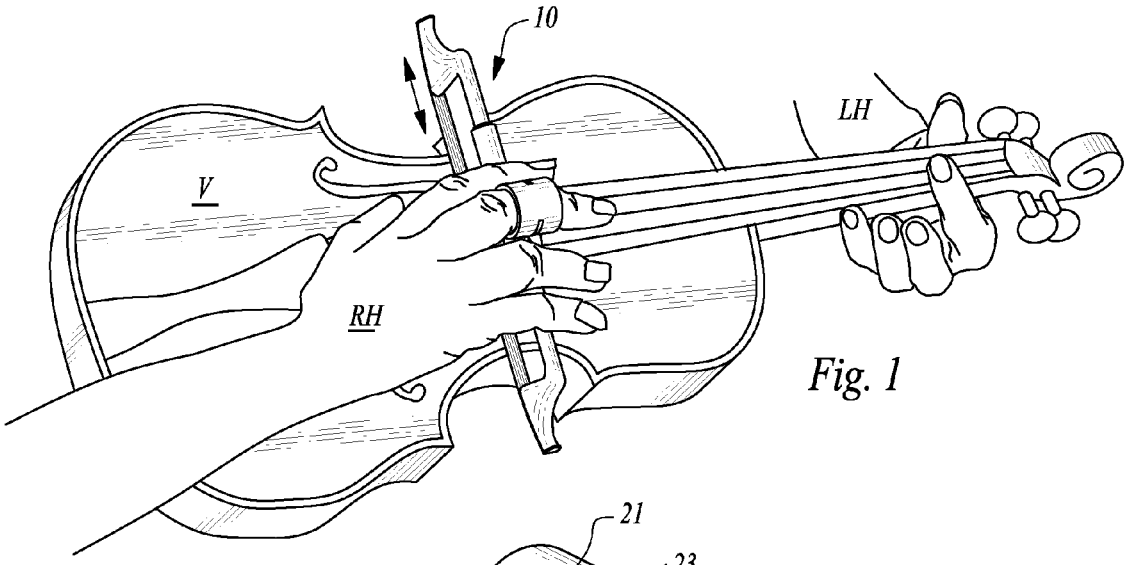
FIG. 1 is a pictorial representation of the hands of a musician playing the violin while using the bow of the present invention.

With reference now to the drawings, and initially to FIG. 1, a violin V is illustrated, or at least envisioned, as resting at or near the lap of a musician. It will be appreciated that the position of the instrument has been hitherto unachievable, thus meeting one of the objectives of the invention. Returning to FIG. 1, the left hand, LH, of the musician is shown fingering the strings of the violin V and in the right hand, RH, is found a bow, 10, constructed in accordance with the present invention.

One of the indelible features of the bow of the present invention is its diminutive length, d, as contrasted to conventional violin bows. The dimension d of the bow 10 of the present invention is, preferably, 12", but may have a range of acceptable lengths of between 4" and 12". The dimension d is measured from the head 12 to the tail 14 of the stick 16.

It will be appreciated that by substantially reducing the length of the dimension d of the bow of the present invention, it is not readily usable with the violin in its customary position under the chin and supported by the shoulder of the musician. Rather than that becoming a deficiency, however, it becomes a benefit and substantially assists in achieving the goals and essential purposes of the present invention. Thus, it is that in FIG. 1 the violin is comfortably positioned at or near the lap of the musician. It will be appreciated that several other positions are made possible and are within the contemplation of the invention.

Figure 2:
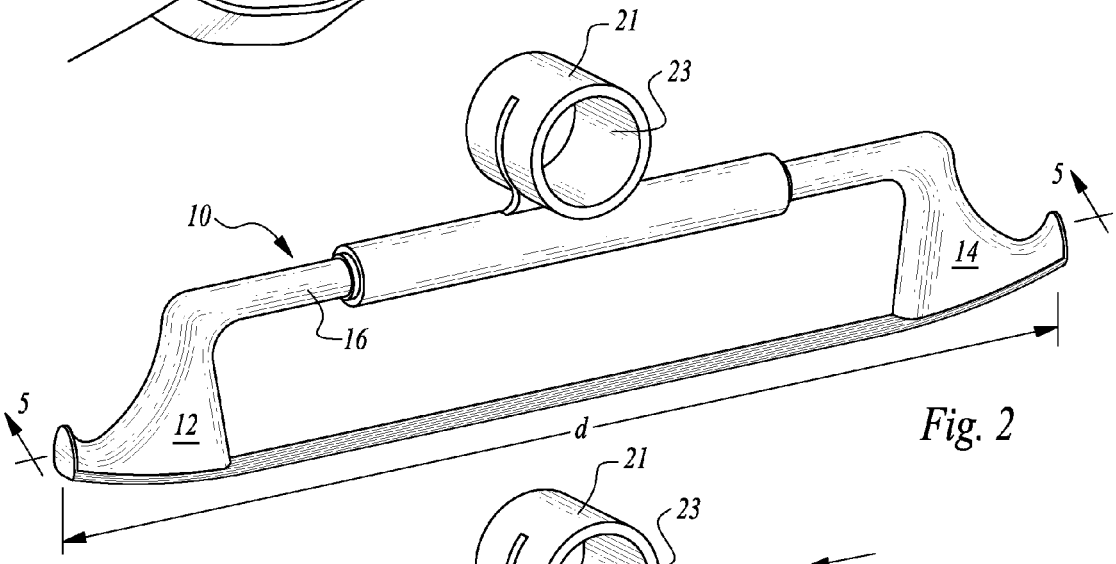
FIG. 2 is a perspective view of the bow of the present invention.
Figure 3:
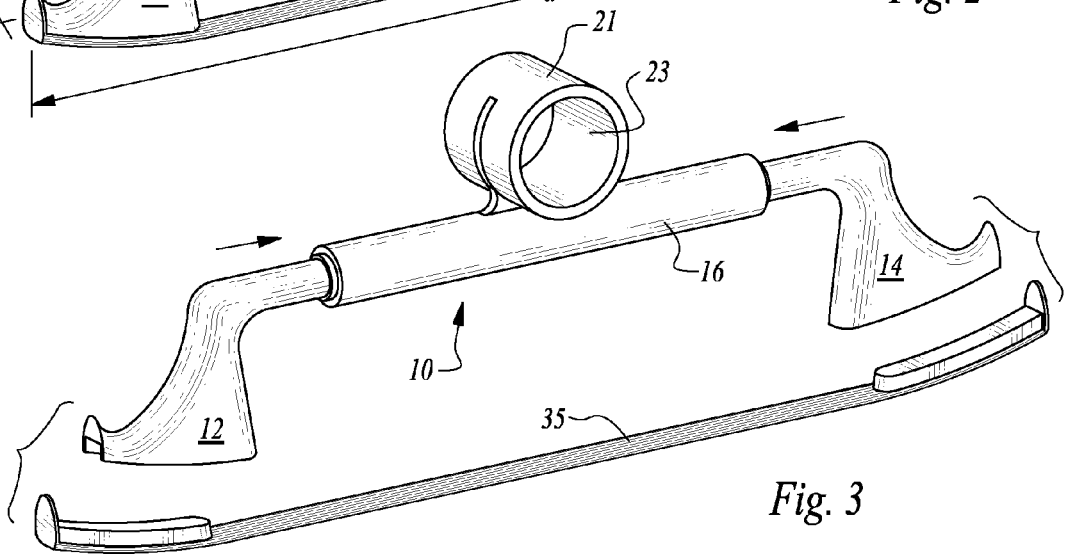
FIG. 3 is a figure similar to FIG. 2, with the string separated from the stick.
Figure 4:
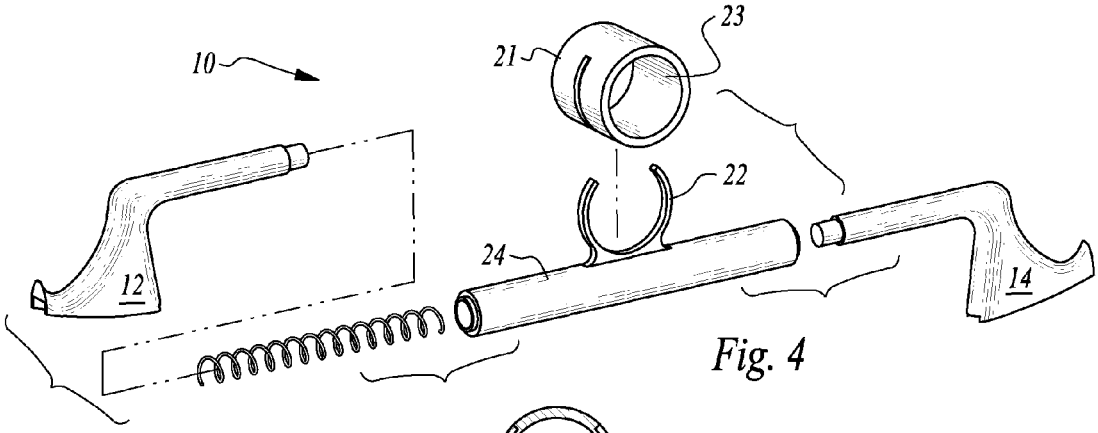
FIG. 4 is a partial exploded view of the bow of the present invention.

Returning to FIG. 2, the bow 10 of the present invention is held in one hand (in this instance the right hand) of the musician and, in accomplishment of this feature, a ring 21 is provided on the stick 16 of the bow 10 and is oriented transverse to the longitudinal axis of the bow 10. The ring 21 is held in position by a clip 22 [best seen in FIG. 4] and provides an aperture 23 of sufficient dimension to receive one of the fingers of the musician's hand. Rings having differing internal diameters to fit differing fingers is within the contemplation of the invention. As shown in FIG. 1, it is the middle finger which is inserted into the aperture 23 to thereby hold the bow 10 securely while playing the instrument. It is well within the contemplation of the invention that the aperture 23 may be connected to the stick 16 in other ways and even formed integrally with the stick itself. With the middle finger in the aperture 23, the fingers on either side are capable of being rested on the stick 16, thereby stabilizing the pressure on the strings of the violin by preventing the bow from rocking back and forth as it is drawn across those strings.

Figure 5:
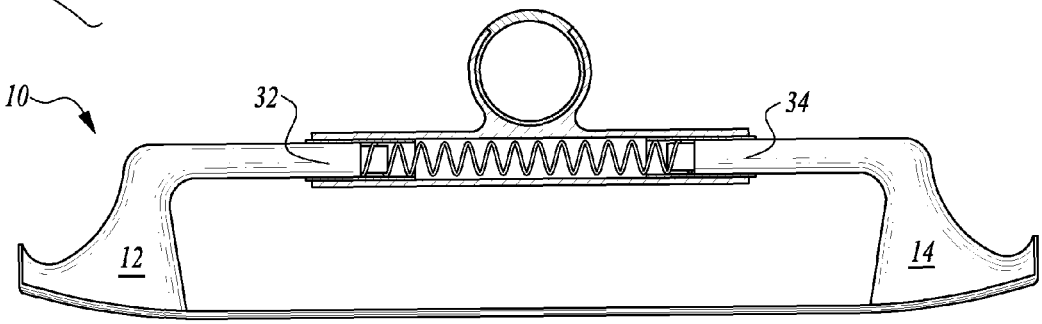
FIG. 5 is a view of the bow of FIG. 1, partially sectioned to show some of the apparatus for tensioning the string.
Figure 6:
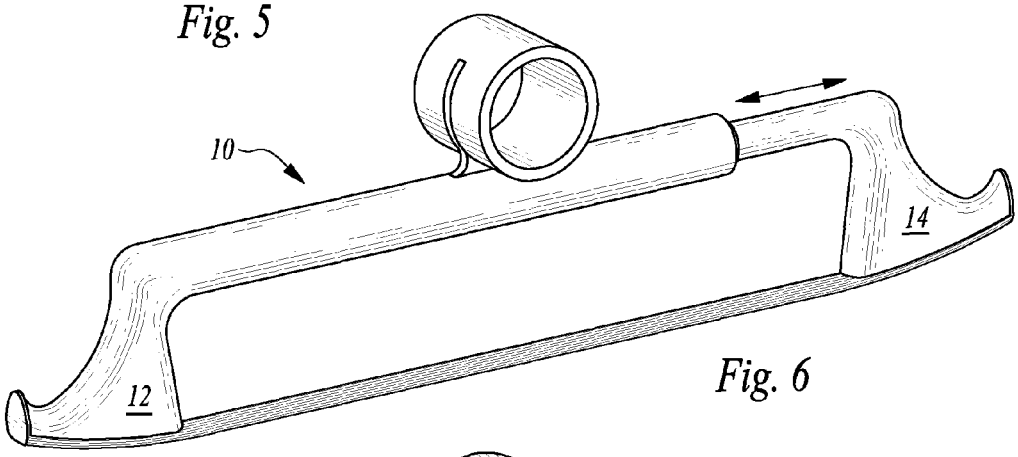
FIG. 6 is a view similar to FIG. 2 with arrows indicating the direction of tensioning of the string; and, FIG. 7 is a view similar to FIG. 5, partially sectioned to show more of the tensioning apparatus.

It is well known that the string 25 of the bow 10 is conventionally comprised of a series of horse hairs held as a compact grouping and secured to the string 16 at its head 12 and tail 14. In practice it has been found that it is desirable to adjust the tension on the string from time to time. In order, therefore, to selectively change the tension of the string, the stick of the present invention is provided with an adjustable mechanism 27, shown in FIGS. 4, 5 and 7.

Figure 7:
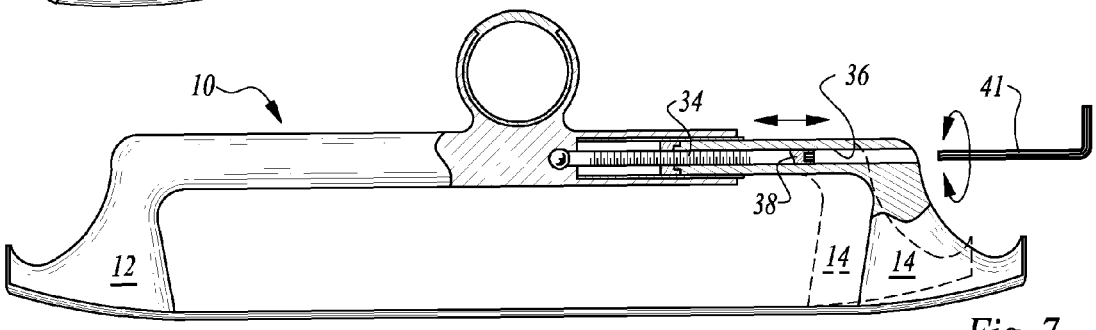

As best seen in the figures so designated, the adjustment mechanism 27 includes a sleeve 29, which consists of a hollow tubing, so dimensioned as to receive the ends 32 and 34, respectively, in longitudinal alignment, of the stick. As seen in FIG. 7, an adjustment screw 34 is situate in an elongated tubular orifice 36, having internal threads capable of receiving a set screw 38, in this instance adjustable by an Allen wrench 41. By rotating the set screw 38, the string 43 is either compressed or expanded to thereby adjust the tension on the string 25.

Those versed in the art will perceive some variation in the several elements of the bow of the present invention. It will be understood, however, that such variations are within the contemplation of the invention as defined in the accompanying claims, wherein:

The invention claimed is:

1. A novel bow for playing a violin in an unusual attitude comprising:

a stick, having a forward end and a rear end; said stick being no more than 12" in length;

hair affixed to said stick between the forward and rear ends thereof;

a ring having an aperture; said aperture on said stick; said aperture being of such size as to receive a finger of the musician to permit the musician to move said bow across the strings of a violin.

2. The novel bow of claim 1, wherein a ring is provided on said stick, said ring having said aperture formed therein.

3. The novel bow of claim 2, wherein said aperture is disposed on said stick at or near the center thereof.

4. The novel bow of claim 1, wherein the length of said stick is adjustable to adjust the tension on said hair.

5. The novel bow of claim 1, wherein said stick is divided into two ends, said ends being positioned in a tube so as to be longitudinally aligned.

6. The novel bow of claim 3, wherein said stick is divided into two ends, said ends being positioned in a tube so as to be longitudinally aligned.

7. A novel bow for playing a violin in an unusual attitude comprising a stick having a forward end and a rear end, said stick being no more than 12 inches in length; hair affixed to said stick between the forward end and rear end thereof; a ring having an aperture; said aperture being of such size as to receive a finger of the musician to permit the musician to move said bow across the strings of a violin; said aperture being positioned on to said stick at or near the center thereof.

8. The novel bow of claim 7, wherein a clip is provided on said stick; said ring is held to said stick by said clip.

9. The novel bow of claim 7, wherein a variety of said rings is provided, each said ring having an aperture of a different diameter.

10. The novel bow of claim 7, wherein the length of said stick is within the range of 4" to 12".

11. The novel bow of claim 7, wherein a screw is in said stick, said screw adapted to adjust the distance between said two pieces to thereby adjust the tension on said hair.

* * * * *